US006689717B2

(12) United States Patent
Fujimori

(10) Patent No.: US 6,689,717 B2
(45) Date of Patent: Feb. 10, 2004

(54) IMAGE RECEIVING SHEET AND TRANSFER IMAGE FORMING METHOD

(75) Inventor: Junichi Fujimori, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/881,847

(22) Filed: Jun. 18, 2001

(65) Prior Publication Data

US 2002/0019311 A1 Feb. 14, 2002

(30) Foreign Application Priority Data

Jun. 23, 2000 (JP) ..... 2000-188882

(51) Int. Cl.[7] ..... B41M 5/00; B41M 5/035; B41M 5/38

(52) U.S. Cl. ..... 503/227; 156/235; 428/32.31; 428/32.87

(58) Field of Search ..... 428/32.31, 32.87; 503/227; 156/235

(56) References Cited

FOREIGN PATENT DOCUMENTS

JP 8-58253 3/1996
JP 8-118831 5/1996
JP 8-238858 9/1996

OTHER PUBLICATIONS

Patent Abstract of Japan, 08–058253, Mar. 5, 1996.

Patent Abstract of Japan, 08–118831, May 14, 1996.

Patent Abstract of Japan, 08–238858, Sep. 17, 1996.

*Primary Examiner*—B. Hamilton Hess
(74) *Attorney, Agent, or Firm*—Sughrue Mion, PLLC

(57) ABSTRACT

An image receiving sheet having a high transfer rate and high sensitivity, and a heat transfer recording method using the image receiving sheet. The image receiving sheet is formed by an image receiving layer disposed on a support. A surface energy of the image receiving layer is 23 to 35 mj/cm$^2$. A cushion layer is preferably formed between the support and the image receiving layer. In the heat transfer recording method, a heat transferable sheet is set in close contact with the image receiving sheet to form an ink image on the image receiving sheet by heat transfer. The ink image is then transferred to a permanent support. The heat transfer recording method uses the image receiving sheet having the image receiving layer with the surface energy of 23 to 35 mj/m$^2$.

20 Claims, 1 Drawing Sheet

IMAGE RECEIVING SHEET AND TRANSFER IMAGE FORMING METHOD

BACKGROUND OF THE INVENTION

1. Field of the Invention

The present invention relates to an image receiving sheet and a heat transfer recording method, and in particular, to an image receiving sheet which includes an image receiving layer having high sensitivity and a heat transfer recording method using the image receiving sheet.

2. Description of the Related Art

Recently, in accordance with offices having been automated, copy machines and printers and the like which use various types of recording formats including an electrophotographic format, an ink jet format, a heat-sensitive transfer recording format and the like, have been used for various types of applications. Among such formats, the heat-sensitive transfer recording format has advantages such as easy operation, easy maintenance, compactness of the device, low costs and the like. Conventionally, two kinds of heat-sensitive transfer recording formats have been known: a heat-melting transfer format and a sublimation dye transfer format. In the heat-melting transfer format, a transfer sheet which has a melting image forming layer on a support is heated imagewise with a thermal head or a laser light to melt and transfer a melting ink to an image receiving sheet for heat-sensitive transfer recording. In the sublimation dye transfer format, a transfer sheet for heat-sensitive transfer recording, which has an image forming layer that contains a heat-diffusing dye (a sublimation dye) on a support, is used. The heat-diffusing dye is diffused and transferred to the image receiving sheet for heat-sensitive transfer recording by being heated.

In these heat-sensitive transfer formats, a heat transfer sheet is set in close contact with an image receiving sheet. Next, by heat-transfer, an ink image is formed on the image receiving sheet. Finally, the ink image is then transferred to a permanent support. In the heat transfer recording format using a conventional image receiving sheet, however, there arise problems in that transfer efficiency is insufficient when the ink image on the heat transfer sheet is heat-transferred to the image receiving sheet, and reflection density of a final image obtained by transferring the ink image on the image receiving sheet to the permanent support is insufficient.

SUMMARY OF THE INVENTION

An object of the present invention is to provide an image receiving sheet having a high transfer rate and high sensitivity, and a heat transfer recording method in which reflection density of a final image can be raised using the image receiving sheet.

In accordance with a first aspect of the present invention, there is provided an image receiving sheet comprising a support and an image layer disposed on the support, wherein the image receiving layer includes surface energy of 23 to 35 mj/m$^2$.

In accordance with a second aspect of the present invention, there is provided an image receiving sheet comprising:

(a) a support;

(b) a first image receiving layer (a cushion layer) including a high polymer disposed on the support; and (c) a second image receiving layer including a high polymer disposed on the first layer, and including an exterior surface comprising a surface energy of 23 to 35 mj/m$^2$.

In accordance with a third aspect of the present invention, there is provided a method of forming an ink image, the method comprising the steps of:

(a) placing an image receiving sheet comprising a support and an image receiving layer disposed on the support, with the image receiving layer including a surface energy of 23 to 35 mj/m$^2$, in close contact with a heat transfer sheet;

(b) forming an image on the image receiving sheet by heat transfer; and (c) transferring the ink image to a permanent support.

DESCRIPTION OF THE PREFERRED EMBODIMENTS

Figure 1:
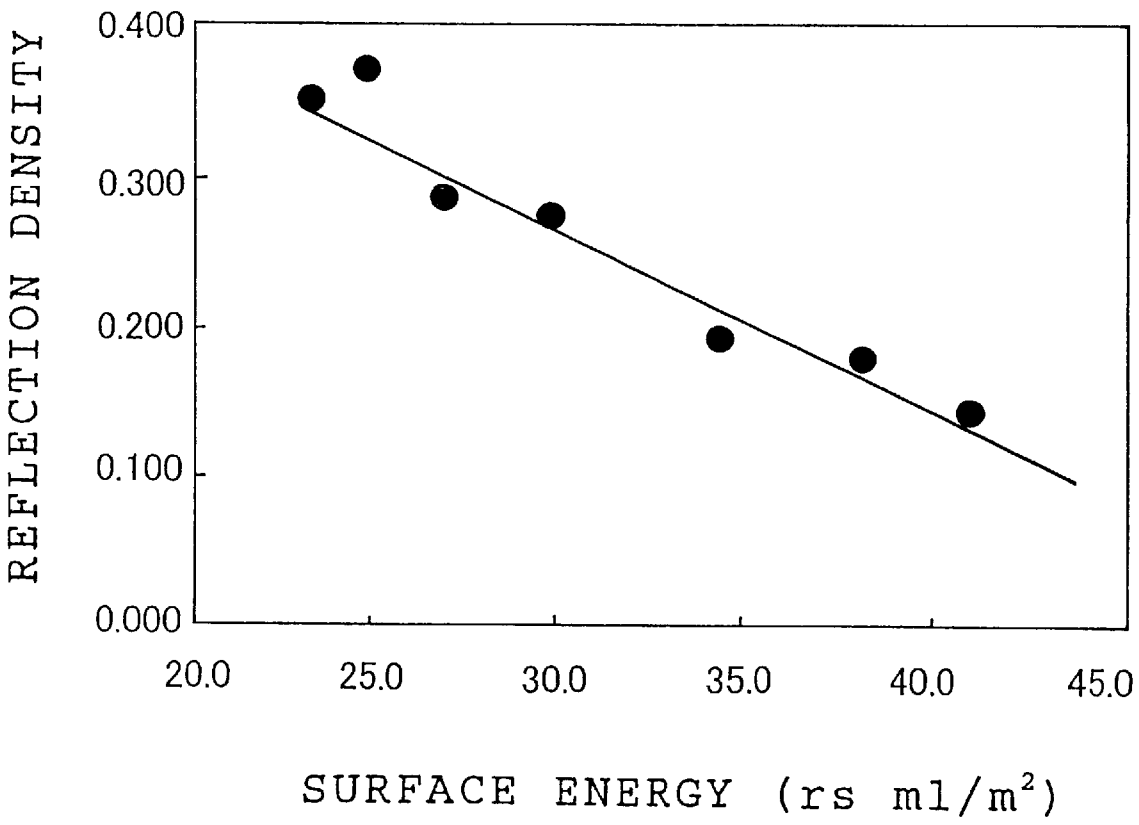
FIG. 1 is a graph showing a relationship between surface energies of image receiving layers of image receiving sheets and reflection densities of final images obtained by heat transfer recording in Comparative Examples and Examples.

Preferred embodiments of the present invention will be described hereinafter.

Image Receiving Sheet

An image receiving sheet according to the present invention has an image receiving layer on a support. Preferably, the image receiving sheet has a cushion layer between the support and the image receiving layer.

Support

Examples of material for the support used in the image receiving sheet include plastic, paper, metal, glass and the like. Examples of the plastic material for the support include polyester (for example, polyethylene terephthalate and polyethylene naphthalate), polyamide, polycarbonate, polyether sulfone, polyimide, polyolefin (for example, polyethylene and polypropylene), polyvinyl chloride, polyurethane, polyvinylidene chloride, polyacrylate and cellulose acetate. Among them, polyethylene terephthalate and polyproplylene are preferable. Especially polyetheylene terephthalate is preferable in view of dimensional stability.

In an embodiment of the present invention, a thickness of the support used for the image receiving sheet is preferably in a range of 50 to 300 $\mu$m and more preferably in a range of 75 to 200 $\mu$m. If the support is a plastic, a support, having two or more layers, with one layer containing air bubbles therein and another layer not containing the air bubbles therein, may be used. A surface of the support on which the image receiving layer is provided may be subjected to surface treatments such as an undercoating treatment to facilitate application of the image receiving layer, and a corona discharge treatment or a glow discharge treatment to increase the adhesive strength between the support and the image receiving layer. An undercoating layer may also be formed on the support. The undercoating layer is not restricted as long as it can increase the adhesive strength between the support and the image receiving layer. For this purpose, a silane coupling agent is particularly preferable. Moreover, the support may be subjected to an antistatic treatment and a matte treatment.

The image receiving sheet of the present invention may have a first backing layer disposed on the support and a second backing layer disposed on the first backing layer. These backing layers preferably contain an antistatic agent. A ratio of a weight B of the antistatic agent contained in the second backing layer to a weight A of the antistatic agent contained in the first backing layer (i.e., B/A) is preferably less than 0.3. If B/A is 0.3 or greater, the backing layers have a worse tendency to slide off of the support and to lose powder of the layers.

A thickness C of the first backing layer is preferably 0.01 to 1 μm and more preferably 0.01 to 0.2 μm. A thickness D of the second backing layer is preferably 0.01 to 1 μm and more preferably 0.01 to 0.2 μm. The ratio of the thickness of the first backing layer to that of the second backing layer (i.e., C:D) is preferably 1:2 to 5:1.

Examples of the antistatic agent used for the first and the second backing layers include compounds such as nonionic surfactants such as polyoxyethylene alkylamine, glycerin fatty acid ester and the like, cation surfactants such as quaternary ammonium salt and the like, anion surfactants such as alkylphosphate and the like, ampholytic surfactants, conductive resins and the like.

Conductive fine particles may also be used as the antistatic agent. Examples of such conductive fine particles include oxides such as ZnO, $TiO_2$, $SnO_2$, $Al_2O_3$, $In_2O_3$, MgO, BaO, CoO, CuO, $Cu_2O$, CaO, SrO, $BaO_2$, PbO, $PbO_2$, $MnO_3$, $MoO_3$, $SiO_2$, $ZrO_2$, $Ag_2O$, $Y_2O_3$, $Bi_2O_3$, $Ti_2O_3$, $Sb_2O_3$, $Sb_2O_5$, $K_2Ti_6O_{13}$, $NaCaP_2O_{18}$, $MgB_2O_5$ and the like; sulfides such as CuS, ZnS and the like; carbides such as SiC, TiC, ZrC, VC, NbC, MoC, WC and the like; nitrides such as $Si_3N_4$, TiN, ZrN, VN, NbN, $Cr_2N$ and the like; borides such as $TiB_2$, $ZrB_2$, $NbB_2$, $TaB_2$, CrB, MoB, WB, $LaB_5$ and the like; silicides such as $TiSi_2$, $ZrSi_2$, $NbSi_2$, $TaSi_2$, $CrSi_2$, $MoSi_2$, $WSi_2$ and the like; metalic salts such as $BaCo_3$, $CaCO_3$, $SrCO_3$, $BaSO_4$, $CaSO_4$ and the like; complexes such as $SiN_4$—SiC, $9Al_2O_3$—$2B_2O_3$ and the like. These compounds may be used alone or in a combination of two or more kinds. Among these compounds, $SnO_2$, ZnO, $Al_2O_3$, $TiO_2$, $In_2O_3$, MgO, BaO and $MoO_3$ are preferable, $SnO_2$, ZnO, $In_2O_3$ and $TiO_2$ are more preferable and $SnO_2$ is especially preferable.

When a conductive metallic oxide is used for the antistatic agent, it is preferable for the particle diameter of the conductive metallic oxide to be small in order to minimize light scattering as much as possible. The particle diameter should be determined using as a parameter a ratio of the refractive index of the particle to that of a binder, and can be calculated using Mie's Theory. In general, the average particle diameter of the conductive metallic oxide is in a range of 0.001 to 0.5 μm and preferably in a range of 0.003 to 0.2 μm. Here, average particle diameter refers to as a value which includes not only a primary particle diameter of the conductive metallic oxide but also a particle diameter of high-order structure.

In addition to the antistatic agent, various kinds of additives such as a surfactant, a sliding agent, a matte agent and the like and a binder can be added to the first and the second backing layers. An amount of the antistatic agent contained in the first backing layer is preferably 10 to 1000 parts by mass and more preferably 200 to 800 parts by mass per 100 parts by mass of the binder. An amount of the antistatic agent contained in the second backing layer is preferably 0 to 300 parts by mass and more preferably 0 to 100 parts by mass per 100 parts by mass of the binder.

Examples of the binder used for forming the first and the second backing layers include homopolymers or copolymers of acrylic monomers such as acrylic acid, methacrylic acid, acrylates, methacrylates and the like, cellulose polymers such as methyl cellulose, ethyl cellulose, cellulose acetate, vinyl polymers and copolymers of vinyl compounds such as polystyrene, vinyl chloride-vinyl acetate copolymer, polyvinyl pyrrolidone, polyvinyl butyral, polyvinyl alcohol, condensed polymers such as polyester and polyamide, rubber thermoplastic polymers such as butadiene-styrene copolymer, polymers prepared by polymerizing or cross-linking light-polymerizable or heat-polymerizable compounds such as epoxy compound and the like, melamine compound and the like.

Image Receiving Layer

An image receiving layer according to the present invention is a layer which contains a high polymer. The image receiving layer may be formed by one layer or may be formed by laminating two or more layers. If the image receiving layer is formed by laminating two or more layers, the surface energy of the image receiving layer at the outermost surface thereof is 23 to 35 mj/$m^2$. Description will be given of an image receiving layer which is formed by laminating two layers, which is a preferable aspect of the present invention. The image receiving layer obtained by laminating two layers is formed by a first image receiving layer formed on a support and a second image receiving layer formed on the first image receiving layer. The first and the second image receiving layers are formed mainly of high polymers. In the present invention, either the first image receiving layer or the second image receiving layer preferably has a cushioning property. Hereinafter, an example in which the first image receiving layer has the cushioning property will be described. Firstly, the first image receiving layer (cushion layer) will be described.

First Image Receiving Layer (Cushion Layer)

It is preferable that at least one high polymer for forming the first image receiving layer is selected from a group of: polyolefins such as polyethylene, polypropylene and the like; ethylene copolymers such as a copolymer of ethylene and vinyl acetate and a copolymer of ethylene and acrylic ester; polyvinyl chloride; vinyl chloride copolymers such as a copolymer of vinyl chloride and vinyl acetate; polyvinylidene chloride; vinylidene chloride copolymers; poly (metha) acrylic esters; polyamide resins such as copolymer nylon, N-nylon alkoxymethylate; synthetic rubbers such as acrylic rubber; organic high polymers such as rubber chloride and the like.

Among these high polymers, high polymers with a polymerization degree of 200 to 2000 (polyvinyl chloride, a copolymer of vinyl chloride and vinyl acetate, a copolymer of vinyl chloride and vinyl alcohol, a copolymer of vinyl chloride, vinyl acetate and maleic acid) are especially preferable because polyvinyl chloride and polyvinyl chloride copolymers have virtually no adhesion at room temperature and relatively small elastic modulus. Further, polyvinyl chloride and polyvinyl copolymers can easily conform to surface unevenness of the transferred image at the time of heat-transfer. Moreover, the adhesive strength between layers can be easily controlled due to effects of a hydroxyl group or a carboxyl group in components of the copolymers. In particular, the elastic modulus can be easily controlled due to a plasticizer.

The thickness of the first image receiving layer is preferably 5 to 50 μm because the thickness thereof needs to be larger than unevenness on the surface of the permanent support when an image that has been transferred onto the image receiving sheet is transferred to the permanent support. Moreover, the thickness of the first image receiving layer must be able to sufficiently tolerate difference in relief level of portions at which four color images overlap. The thickness of the first image receiving layer must be such that even if dust adheres at the time of image formation, image defects caused by the dust do not occur (the dust can be absorbed). Further, in order to obtain sufficient cushioning property, a thickness of 5 to 50 μm is necessary.

The first image receiving layer is preferably formed with an elastic modulus of $49\times10^4$ kPa or less. By making the elastic modulus smaller, cushioning property arises in the image receiving layer, whereby recording sensitivity, dot quality and gradation reproducibility are improved. Further, even if foreign materials such as dust is present between the transfer sheet and the image receiving sheet at the time of heat-transfer recording, it becomes difficult for image defects to occur because of the cushioning property of the first image receiving layer. Moreover, at the time an image that has been transferred to the image receiving sheet is transferred onto a printing paper such as paper by pressure or heat applied thereto, the first image receiving layer is embedded into the paper in conformity with the surface unevenness of the paper. Thus, high adherence between the image receiving sheet and the paper can be obtained. Moreover, a surface luster of the resultant image is similar to that of the original image even if a special treatment, such as making the surface of the resultant image matte after the second image receiving layer is peeled, is not carried out.

A plasticizer can be added to the above-described organic high polymer. Examples of the plasticizer include phthalic esters (for example, dibutyl phthalate, di-n-octyl phthalate and butyl benzyl phthalate), aliphatic dibasic acid esters (for examaple, di-(2-ethylhexyl) adipate and di-(2-ethylhexyl) sebacate), phosphoric triesters (for example, tricresyl phosphate), polyol esters (for example, polyethylene glycol ester), epoxy compounds (for example, epoxy fatty acid ester), acrylates (for example, polyethylene glycol dimethacrylate, pentaerythritol triacrylate). In order to adjust the adhesive strength between the first image receiving layer and the support or between the first image receiving layer and the second image receiving layer, various kinds of polymers, an adhesion improvement agent, a surfactant or a mold releasing agent can be added to the organic high polymer. Moreover, in order to reduce the elastic modulus, it is very effective to use partially an adhesive polymer in addition to the high polymer.

When a vinyl chloride resin is used as the high polymer, it is effective to add an organic tin stabilizer such as a butyl tin stabilizer or an octyl tin stabilizer, both of which are generally known as stabilizers for polyvinyl chloride and vinyl chloride copolymers.

Second Image Receiving Layer (Image Receiving Layer)

In the present invention, the surface energy of the image receiving layer is 23 to 35 mj/m$^2$ and preferably 23 to 30 mj/m$^2$. It is substantially difficult to make the surface energy of the image receiving layer less than 23 mj/m$^2$. If the surface energy exceeds 35 mj/m$^2$, the transfer rate of the ink image to the transfer sheet decreases such that the reflection density of the final image also decreases. The surface energy of the image receiving layer is preferably an energy value which approximates the surface energy of the image forming layer of the transfer sheet used together with the image receiving sheet, within the above-mentioned ranges.

The surface energy of the image receiving layer in the present invention is a numerical value measured in the following manner.

Surface energies of a solid and of a liquid are represented by the following Formulae 1 and 2, respectively. There exists a relationship represented by Formula 3 obtained by combining Fowkes's formula with Young's formula between $\gamma_S^d$, $\gamma_S^P$, contact angle θ when the solid surface is wetted by the liquid and $\gamma_L^d$, $\gamma_L^P$ of the liquid. Accordingly, the contact angle is measured using two kinds of liquids, in each of which $\gamma_L^d$, $\gamma_L^P$ are known. With these values, a simultaneous quotation represented by Formula 3 is solved. In this way, $\gamma_S^d$, $\gamma_S^P$ are determined. As a result, the surface energy of the solid can be computed.

In the present invention, the humidity of an image receiving sheet to be measured was adjusted at 23° C. and 50% RH overnight. Then, the surface contact angle of the image receiving sheet was measured using a surface contact angle meter (a CA-A type contact angle meter manufactured by Kyowa Interface Science Co., Ltd.). The measured solvents were ethylene glycol and n-hexanedecane. The surface contact angle was measured at five points on the image receiving sheet for each measured solvent. Then, an average value of five points was computed for each solvent. Using resultant average values and $\gamma_L$, $\gamma_L^d$, and $\gamma_L^P$ of respective solvents shown in Table 1, the surface energy of the image receiving surface was computed.

Formula 1: $\gamma_L=\gamma_L^d+\gamma_L^P$

Formula 2: $\gamma_S=\gamma_S^3+\gamma_S^P$

Formula 3: $\gamma_L(1+\cos\theta)=2(\gamma_S^d\cdot\gamma_L^d)^{1/2}+(\gamma_S^P\cdot\gamma_L^P)^{1/2}$ $\gamma_L$: surface energy of solvent θ: contact angle $\gamma_S^d$: diffusive component of surface energy of solid $\gamma_S^P$: polar component of surface energy of solid $\gamma_L^d$: diffusive component of surface energy of solvent $\gamma_L^P$: polar component of surface energy of solvent

TABLE 1

| Solvent | $\gamma_L^d$ (mj/m$^2$) | $\gamma_L^P$ (mj/m$^2$) |
|---|---|---|
| ethylene glycol | 31.6 | 15.9 |
| n-hexadecane | 27 | 0 |

Purposes for forming the second image receiving layer (image receiving layer) are as follows. A purpose is to receive an image by heat-transfer. Next, another purpose is to obtain an image whose gloss is similar to that of the original image without carrying out a special matting treatment because when the image receiving sheet is peeled at a time of transferring an image to a permanent support, peeling is carried out between the first image receiving layer and the second image receiving layer such that only thin second image receiving layer remains on the image on the permanent support having unevenness. Moreover, yet another purpose is to improve a damage resistance of an image.

Similar to the first image receiving layer, the second image receiving layer is preferably made of a resin material. Examples of the resin material which can form the second image receiving layer include, in addition to various kinds of organic high polymers used for the first image receiving layer, a vinyl acetate copolymer, an acetal resin such as polyvinyl butyral or the like, an alkylacrylate-acrylamide copolymer, a modified polyvinyl alcohol, a phenol resin, an epoxy resin, a urethane resin, a polyester resin, a urea resin, a melamine resin, an alkyd resin, a maleic resin, a hydroxystyrene copolymer, a sulfonamide resin, a cellulose resin, an ester gum and a rosin. Especially, the second image receiving layer is preferably formed using a polyvinyl butyral and an alkylacrylate-acrylamide copolymer.

Other adhesion improvement agents, plasticizers, mold releasing agents and surfactants can be added to such resins in order to satisfy relationships of adhesive strengths at various interfaces. As an applying solvent which is used for the second image receiving layer, it is preferable to use an applying solvent which does not dissolve or swell a resin used in the first image receiving layer in order to prevent mixing of the first image receiving layer with the second image receiving layer due to permeation of the applying solvent into an underlying layer at a time of applying thereof. For example, if a vinyl chloride resin which has relatively good solubility with respect to various solvents is used for the first image receiving layer, an alcoholic or an aqueous applying solvent is preferably used.

The thickness of the second image receiving layer is preferably in a range of 0.1 to 10 μm (more preferably in a range of 0.5 to 5 μm). If the thickness is too large, the appearance of unevenness in the surface of a permanent support is deteriorated and the surface of the permanent support becomes too glossy. As a result, reproducibility of the original image is easily reduced. When an image receiving sheet is formed by two layers, the thicknesses of the first image receiving layer and of the second image receiving layer can be freely set in the above-mentioned ranges.

In order to generate the peeling between an organic polymer material in the first image receiving layer and an organic polymer material in the second image receiving layer when peeling the image receiving sheet at the time of transferring the image to the permanent support, a balance of an adhesive strength between layers is important. To control the adhesive strength between layers, in addition to selecting an applying solvent to prevent mixing of the first image receiving layer and the second image receiving layer at the time of laminating and applying thereof, it is effective to select combinations of materials including a combination of a hydrophilic polymer and a lipophilic polymer and a combination of a polar polymer and a non-polar polymer, and to add an adhesion improvement agent such as a silane coupling agent or the like, various kinds of additives which have fluorine-based or silicone-based mold release and hardening, and a surfactant, into the first or the second image receiving layer.

An intermediate layer may be provided between the first image receiving layer and the second image receiving layer in order to improve the close contact therebetween. The above explanation has been made in a case in which the cushioning property is applied to the first image receiving layer of the image receiving layer. If the second image receiving layer is made thicker and softer than the first image receiving layer, it is possible to apply the cushioning property and the image forming function to the second image receiving layer. In such a case, the first image receiving layer serves as a peeling layer. The same kinds of materials as the above-described materials can be used for an image receiving layer with such a structure.

The image receiving sheet of the present invention may be formed by one image receiving layer. In this case, the above-described second image receiving layer is provided directly on the support to form the image receiving layer. The thickness of the image receiving layer when the image receiving layer is formed by a single layer is in a range of 0.2 to 80 μm (preferably in a range of 0.5 to 50 μm).

An antistatic agent can be added to the second image receiving layer in order to suppress generation of static electricity. As the antistatic agent, at least one kind is selected and used from a group of polyether compound, polyether ester compound, diethanolamine compound, diethanolamide compound, polyacrylate, polystyrene sulfonate, ammonium salt compound, pyridinium compound and betaine oxide. A surfactant is added to the second image receiving layer coating solution in order to maintain the surface property of the second image receiving layer. In order to maintain the surface energy of the second image receiving layer of 23 to 35 mj/m$^2$, for example, it is preferable to adjust added amounts of the antistatic agent and the surfactant.

Transfer Sheet

Next, a description will be given of a transfer sheet used in combination with the image receiving sheet of the present invention. The transfer sheet has, on a support, a light-to-heat conversion layer, an image forming layer and a heat-sensitive peeling layer if necessary.

Support

The material for the support of the transfer sheet is not particularly limited and various kinds of materials for the support can be used as needed. Preferable examples of such materials for the support include synthetic resins such as polyethylene terephthalate, polyethylene-2,6-naphthalate, polycarbonate, polyethylene, polyvinyl chloride, polyvinylidene chloride, polystyrene and styrene-acrylonitrile copolymer and the like. Among these materials, biaxial oriented polyethylene terephthalate is preferable from its mechanical strength and dimensional stability with respect to heat. If the image receiving sheet of the present invention is formed for forming a color proof, an opaque sheet material such as a printing paper is generally used as the support of an image receiving sheet. Thus, the support of the transfer sheet is preferably formed by a transparent, laser-light transmitting synthetic resin material.

In order to improve the close contact between the support of the transfer sheet and the light-to-heat conversion layer to be described later, it is preferable to carry out a surface activation treatment and/or to apply one or more undercoating layers. Examples of the surface activation treatment include a glow discharge treatment, a corona discharge treatment and the like. The material for the undercoating layer preferably has high adhesive property to the surfaces of both the support and the light-to-heat conversion layer, low thermal conductivity and excellent heat resistance. Examples of such material for the undercoating layer include styrene, styrene-butadiene copolymer, gelatin and the like. The total thickness of the undercoating layer is generally selected so as to be in a range of 0.01 to 2 μm. Various kinds of functional layers such as a reflection prevention layer and the like may be provided on the surface of the transfer sheet at the side opposite the side on which the light-to-heat conversion layer is provided, or a surface treatment can be carried out, if desired. A backing layer may be provided on the surface of the transfer sheet at the side opposite the side on which the light-to-heat conversion layer is provided. The same structure as that of the above-described backing layer of the image receiving sheet can be used for the backing layer of the transfer sheet.

Light-to-Heat Conversion Layer

If the transfer sheet and the image receiving sheet of the present invention are used in an ablation method, a light-to-heat conversion layer is preferably provided on the support of the transfer sheet. The light-to-heat conversion layer is formed by coating a coating solution containing a light-to-heat conversion material and a binder and drying the solution. In general, the light-to-heat conversion material is a dye which can absorb laser light (a pigment or the like). Examples of such dye (pigment) include a black pigment such as carbon black, a pigment which is a macrocyclic compound capable of absorbing rays in ranges from the visible range to the near-infrared range such as phthalocyanine, naphthalocyanine, an organic dye used as a laser absorbing material for high density laser recording in an optical disc (cyanine dye such as indolenine dye, anthraquione dye, azulene dye and phthalocyanine dye) and an organometallic compound dye such as dithiol/nickel complex. In order to increase recording sensitivity, the light-to-heat conversion layer is preferably as thin as possible. Thus, it is preferable to use the cyanine dye or the phthalocyanine dye, which exhibits a large absorption coefficient in a laser light wavelength range. An inorganic material such as a metallic material can also be used as the laser light absorbing material for the light-to-heat conversion layer. The metallic material is used in the form of particles (for example, blackened silver).

Examples of the material for the binder in the light-to-heat conversion layer include, but are not especially limited to, homopolymers or copolymers of acrylic monomers such as acrylic acid, methacrylic acid, acrylates, methacrylates and the like, cellulose polymers such as methyl cellulose, ethyl cellulose, cellulose acetate and the like, vinyl polymers and copolymers of vinyl compounds such as polystyrene, vinyl chloride-vinyl acetate copolymer, polyvinyl pyrrolidone, polyvinyl butyral, polyvinyl alcohol and the like, condensed polymers such as polyester, polyamide and the like, rubber thermoplastic polymer such as butadiene-styrene copolymer, polymers prepared by polymerizing and cross-linking a light- or a heat-polymerizable compound such as epoxy compound, and the like.

In the light-to-heat conversion layer formed by the above-described manner, the solid weight ratio of the dye (dye or pigment) to the binder (dye: binder) is preferably in a range of 1:20 to 2:1 and especially preferably in a range of 1:10 to 2:1. If an amount of the binder is too small, the cohesive strength of the light-to-heat conversion layer decreases, so that when a formed image is transferred to an image receiving sheet, the light-to-heat conversion layer is apt to be transferred together with the formed image, which causes color mixing of the image. Alternatively, if the amount of the binder is too large, the thickness of the light-to-heat conversion layer must be large in order to accomplish a fixed light absorption ratio, resulting in a decrease in sensitivity. The thickness of the light-to-heat conversion layer formed by above-mentioned dye and binder is preferably in a range of 0.03 to 0.8 $\mu$m and more preferably in a range of 0.05 to 0.3 $\mu$m. The light-to-heat conversion layer has a maximum absorbance (optical density) in a range of 0.1 to 1.3 (more preferably in a range of 0.2 to 1.1), in a wavelength range of 700 to 2000 nm.

Heat-Sensitive Peeling Layer

The transfer sheet used in the ablation method is preferably provided with a heat-sensitive peeling layer on the light-to-heat conversion layer to carry out the ablation method more effectively. The heat-sensitive peeling layer generates a gas or releases adhered water by being decomposed due to heat converted in the light-to-heat conversion layer, and thus weakens the adhesive strength between the light-to-heat conversion layer and the image forming layer.

The heat-sensitive peeling layer contains a heat-sensitive material which generates a gas by the action of heat. Examples of the heat-sensitive material include a compound which itself decomposes or deteriorates due to heat to generate a gas (a polymer or a low molecular compound), a compound which absorbs or adsorbs a considerable amount of easily vaporizable gas such as water or the like, as its characteristic. These compounds can be used in combination. Examples of the polymer which decomposes or deteriorates due to heat to generate a gas include an auto-oxidizable polymer such as nitrocellulose or the like, a halogen-containing polymer such as chlorinated polyolefin, chlorinated rubber, polychlorinated rubber, polyvinyl chloride, polyvinylidene chloride or the like, an acrylic polymer such as polyisobutyl methacrylate into which a volatile compound such as water is adsorbed, a cellulose ester such as ethyl cellulose in which a volatile compound such as water is adsorbed, a natural polymer compound such as gelatin in which a volatile compound such as water is adsorbed. Examples of the low molecular polymer compound which decomposes or deteriorates due to heat to generate a gas include a compound such as a diazo compound or an azide compound which exothermically decomposes to generate a gas. It is preferable that such decomposition or deterioration of the heat sensitive material due to heat occurs at 280° C. or below and it is more preferable that the decomposition or deterioration occurs at 230° C. or below.

If the low molecular compound is used as the heat-sensitive material in the heat-sensitive peeling layer, the low molecular compound is desirably used in combination with a binder. As such binder, the above-mentioned polymer which itself decomposes or deteriorates to generate a gas may be used or an ordinary polymer binder which does not have the characteristic of decomposing or deteriorating to generate a gas may be used. If the heat-sensitive low molecular compound is used together with the binder, a weight ratio of the heat-sensitive low molecular compound to the binder is preferably in a range of 0.02:1 to 3:1, especially in a range of 0.05:1 to 2:1. The heat-sensitive peeling layer preferably covers substantially the entire surface of the light-to-heat conversion layer. The thickness of the heat-sensitive peeling layer is generally in a range of 0.03 to 1 $\mu$m and especially in a range of 0.05 to 0.5 $\mu$m.

In order to prevent visibly apparent color mixing of an image even if a portion of the heat-sensitive peeling layer is transferred to the image receiving sheet, the heat-sensitive peeling layer is desirably substantially non-colored (i.e., exhibits high transparency with respect to visible light). Specifically, the light absorption ratio of the heat-sensitive peeling layer with respect to visible light is less than 50%, and more preferably less than 10%.

The above-described heat-sensitive material may be added to the light-to-heat conversion layer. If the heat-sensitive material is added to the light-to-heat conversion layer and the light-to-heat conversion layer has the function of the heat-sensitive peeling layer, the heat-sensitive peeling layer is not necessarily essential. If the heat-sensitive peeling layer is formed individually, the heat resistance of the binder in the light-to-heat conversion layer is desirably higher than that of the heat-sensitive material in the heat-sensitive peeling layer. That is, the thermal deformation temperature or the thermal decomposition temperature of the binder in the light-to-heat conversion layer is preferably higher than that of the heat-sensitive material in the heat-sensitive peeling layer.

Image Forming Layer

An image forming layer is provided on the light-to-heat conversion layer and the support or on the heat-sensitive peeling layer. The image forming layer of the transfer sheet used in the heat-melting transfer format contains mainly a coloring agent for visualizing a recorded image and a thermoplastic binder. The image forming layer of the transfer sheet used in the sublimation dye transfer format contains mainly a sublimation dye for visualizing a recorded image and a thermoplastic binder.

The coloring agent contained in the image forming layer of the transfer sheet used in the heat-melting transfer format can be appropriately selected and used among dyes or pigments which are conventionally known in the heat-melting transfer sheet. Examples of such dyes include azo dyes such as Disperse Red 1, Disperse Yellow 3, Disperse Yellow 23, Disperse Yellow 60 and the like, anthraquinone dyes such as Disperse Violet 28, Disperse Blue 14, Disperse Blue 26, Disperse Red 4, Disperse Red 60, Disperse Yellow 13 and the like, and dyes such as Disperse Yellow 54, Disperse Yellow 61, Disperse Yellow 82, Disperse Blue 20 and the like.

The pigment is usually divided roughly into an organic pigment and an inorganic pigment. The organic pigment provides excellent transparent film, while the inorganic pigment is excellent in concealability. If the transfer sheet is used for printing color correction, the organic pigment is suitably used whose hue is identical or close to yellow, magenta, cyan or black generally used in printing ink. In addition to these pigments, metal powders, a fluorescent pigment or the like may also be used. Examples of suitably used pigments include an azo pigment, a phthalocyanine pigment, an antraquinone pigment, a dioxiazine pigment, a quinacridone pigment, an isoindolinone pigment and a nitro pigment. Typical pigments according to hue are shown below.ps 1) Yellow Pigment Hansa Yellow G, Hansa Yellow 5G, Hansa Yellow 10G, Hansa Yellow A, Pigment Yellow L, Permanent Yellow NCG, Permanent Yellow FGL, Permanent Yellow HR;

2) Red Pigment

Permanent Red 4R, Permanent Red F2R, Permanent Red FRL, Lake Red C, Lake Red D, Pigment Scarlet 3B, Bordeaux 5B, Alizarin Lake, Rhodamine Lake B;

3) Blue Pigment

Phthalocyanine Blue, Victoria Blue Lake, Fast Sky Blue;

4) Black Pigment

Carbon Black.

A yellow dye, a magenta dye, and a cyan dye can be used for the sublimation dye contained in the image forming layer of the transfer sheet used in the sublimation dye transfer format. Examples of the yellow dye include Kayaset Yellow AG, Kayaset Yellow 963, MS Yellow VP, MS Yellow VPH, MS Yellow HSO-246, Macrolex Yellow 6G, Foranbrilliant Yellow S-6GL, SYS-1, methine dye, quinophthalon dye, azo dye. Examples of the magenta dye include Kayaset Red TD-FB, MS Magenta VP, MS Magenta HM-1450, MS Magenta HSO-147, MS Magenta HM-1450, MS Red G, Macrolex Red Violet R, Kayaset Red 130, SMS-2, SMS-3, SMS-4, antraquinone dye, azomethine dye and azo dye. Examples of the cyan dye include Kayaset Blue 714, Kayaset Blue FR, Kayaset Blue 136, Kayaset Blue 814, Kayaset Blue 778, MS Cyan VPG, MS Cyan HM-1238, MS Cyan HSO-144, MS Cyan HSO-16, Seles Blue, SCM-1, naphthoquinone dye, antroquinone dye and azomethine dye.

Examples of the thermoplastic binder for the image forming layer of the transfer sheet used in the heat-melting transfer format or in the sublimation dye transfer format include cellulose derivatives such as methyl cellulose, ethyl cellulose, cellulose triasetate and the like, homopolymers or copolymers of acrylic acid monomers such as acrylic acid, methcrylic acid, acrylate, methacrylate and the like, vinyl polymers such as polyvinyl chloride, vinyl acetate, polyvinyl butyral, polyvinyl formal and the like, styrene polymers such as polystyrene, styrene-maleic acid copolymer and the like, rubber polymers such as polybutadiene, polyisoprene and the like, polyorefin and copolymers thereof such as polyethylene, ethylene-vinyl acetate copolymer and the like, phenol resin and ionomer resin. Among such resins, a resin having Tg of 30 to 120° C. is preferable and preferable examples thereof include polyvinyl butyral and acrylic polymer. An average molecular weight of the thermoplastic polymer is desirably in a range of 5000 to 100000. A weight ratio of the coloring agent (or the sublimation dye) to the thermoplastic resin binder in the image forming layer is preferably in a range of 0.5:1 to 4:1.

The image forming layer may contain a plasticizer. That is, if multiple image layers (image forming layers on which images have been formed) are superposed on the same image receiving sheet in order to form a multi-color image, the plasticizer is preferably contained in the image forming layer in order to improve the close contact between image layers. Examples of the plasticizer include phthalic esters such as dibutyl phthalate, di-n-octyl phthalate, di-(2-ethylhexyl) phthalate, dinonyl phthalate, dilauryl phthalate, butyl lauryl phthalate, butyl benzyl phthalate and the like, aliphatic dibasic acid esters such as di-(2-ethylhexyl) adipate, di-(2-ethylhexyl) sebacate and the like, phosphoric triesters such as tricyresyl phosphate, tri-(2-ethylhexyl) phosphate and the like, polyol polyesters such as polyethylene glycol ester and the like and epoxy compounds such as epoxy fatty acid ester and the like. In addition to the above-mentioned conventional plasticizers, acrylates such as polyethylene glycol dimethacrylate, 1,2,4-butanetriol trimethacrylate, trimethylolethane triacrylate, pentaerythritol acrylate, pentaerythritol tetraacrylate, dipentaerythritol-polyacrylate and the like may be suitably used depending on the type of the binder to be used. These plasticizers may be used in a combination of two or more kinds.

In general, the plasticizer is used in the image forming layer such that the weight ratio of the total amount of the coloring agent (or the sublimation dye) and the binder to the plasticizer is in a range of 100:1 to 100:3 and preferably in a range of 100:2 to 100:15. In addition to the above-described components, a surfactant, a viscosity enhancement agent and the like may be added to the image forming layer, if desired. The thickness (dry thickness) of the image forming layer may be changed depending on purposes, but usually does not exceed 10 $\mu$m. The thickness thereof is usually adjusted in a range of 0.1 to 2 $\mu$m (preferably in a range of 0.1 to 1.5 $\mu$m).

Heat Transfer Recording Method

An image forming laminate formed by the heat transfer sheet and the image receiving sheet of the present invention can be formed by various methods. For example, the image forming laminate can be easily formed by superposing the image forming layer side of the heat transfer sheet and the image receiving side (the image receiving layer side) of the image receiving sheet with each other and passing them through a press-and-heat roller. In this case, a heating temperature is preferably less than 160° C. or less than 130° C.

As another method for forming the image forming laminate, a vacuum contact method is also appropriately used. Firstly, an image receiving sheet is rolled around a drum at which suction holes for vacuum-suctioning are formed. Next, a heat transfer sheet which has a little larger size than the image receiving sheet is set in close contact with the image receiving sheet while an air being uniformly discharged using a squeeze roller.

Moreover, there is a method in which the heat transfer sheet is set in close contact with the image receiving sheet by the image receiving sheet being mechanically adhered around a metal drum while being pulled taut, and the heat transfer sheet being also mechanically adhered thereon while being pulled taut in the same manner. Among such methods, the vacuum contact method is especially preferable from the standpoints of a temperature control such as a heat roller or the like being unnecessary and ease with which layers may be rapidly and evenly superposed.

Next, an example of the image forming method using the heat transfer sheet of the present invention will be explained.

In the image forming method using the heat transfer sheet of the present invention, an image forming laminate, in which an image receiving sheet is superposed on the surface of an image forming layer of the heat transfer sheet, is prepared. Laser light is irradiated imagewise onto the surface of the laminate in a time series. Thereafter, the image receiving sheet is peeled from the heat transfer sheet such that the image receiving sheet to which an area of the image forming layer subjected to laser irradiation has been transferred. The heat transfer sheet may be made to closely contact the image receiving sheet immediately before the laser light irradiation operation. The laser light irradiation operation is usually carried out as follows. Firstly, the image receiving sheet side of the image forming laminate is set in close contact with the surface of a recording drum (a rotating drum which has a vacuum forming mechanism therein and on whose surface multiple small openings are formed) by vacuum-suctioning. In this state, laser light is irradiated from outside of the laminate, i.e., from the heat transfer sheet side thereof. The irradiation of the laser light is such that the recording drum is scanned by being irradiated with the laser light which reciprocates in a widthwise direction of the drum. The drum is rotated at a fixed angular speed during the irradiation operation.

Examples of the laser light include direct laser lights including gas laser lights such as an argon ion laser light, a helium/neon laser light, a helium/cadmium laser light and the like, solid laser lights such as a YAG laser light and the like, a semiconductor laser, a dye laser light, an excimer laser light and the like. Alternatively, light, generated by halving the wavelength of the above-mentioned laser lights through a secondary harmonics element can also be used. In the image forming method using the heat transfer sheet of the present invention, in view of an output power, ease of modulation and the like, the semiconductor laser is preferably used. Moreover, in the image forming method using the heat transfer sheet of the present invention, a laser light is preferably irradiated such that the beam diameter on the light-to-heat conversion layer is in a range of 5 to 50 (especially in a range of 6 to 30 $\mu$m). The scanning speed is preferably at least 1 m/second (especially at least 3 m/second).

The image forming method using the heat transfer sheet of the present invention can be used advantageously not only for forming a black mask or a monochromatic image but also for forming a multicolor image. In order to form the multicolor image by the image forming method using the heat transfer sheet of the present invention, for example, an image forming laminate which contains a coloring agent representing the hue of that color is prepared for each color. In a case of a three-color image, for example, three laminates are required, and in a case of four-color image, four laminates are required. Laser light is irradiated on each of the laminates on the basis of digital signals based on the image obtained via a color separation filter. Thereafter, the image recording transfer sheet is peeled from the image receiving sheet in each laminate. Color-separated images of respective colors are independently formed on the respective image receiving sheets, and thereafter, each of color-separated images is successively transferred on the actual substrate, such as separately prepared printing paper or the like or a similar substrate, so that the image is formed.

As the image forming method using laser light, there has been used an image forming method which utilizes a so called "ablation", which is disclosed in U.S. Pat. No. 5,352,562 or in Japanese Patent Application Laid-Open (JP-A) No. 6-219052. Specifically, in this image forming method, a transfer sheet in which a light-to-heat conversion layer and a heat-sensitive peeling layer are provided between a support and an image forming layer (or a transfer sheet in which, if a heat-sensitive material is contained in the light-to-heat conversion layer, the light-to-heat conversion layer which has the function of the heat-sensitive peeling layer is provided) and an image receiving sheet which is superposed on the image forming layer are used. Due to irradiation of a laser light, the temperature of the light-to-heat conversion layer is increased such that the light-to-heat conversion layer deteriorates and melts. As a result, the ablation occurs, and the heat-sensitive peeling layer is partially decomposed and vaporized. Thus, the bonding strength between the image forming layer and the light-to-heat conversion layer is weakened such that an area of the image forming layer, in which the bonding strength between the image forming layer and the light-to-heat conversion layer weakens, is transferred to the image receiving sheet.

EXAMPLES

Examples of the present invention will be explained hereinafter, but the present invention is not limited to these examples.

Comparative Example 1

Forming of Image Receiving Sheet

A cushion intermediate layer coating solution and an image receiving layer coating solution which had the following compositions were prepared by being heated and dissolved.

| (Composition of Cushion Intermediate Layer Coating Solution) | |
|---|---|
| binder<br>vinyl chloride/vinyl acetate copolymer<br>polymerization degree: 300<br>vinyl chloride/vinyl acetate = 86/14<br>(SORVINE CL2 manufactured by Nisshin Chemical Industry Co., Ltd.) | 160 parts by mass |
| plasticizer<br>polyester adipate<br>weight average molecular weight: 18000<br>(FN-G40 manufactured by Nippon Soda Co., Ltd.) | 180 parts by mass |
| stabilizer<br>(KS2000A manufactured by Kyodo Chemical Co., Ltd.) | 1.4 parts by mass |
| surfactant<br>(MEGAFAC F-113 manufactured by Dainippon Ink and Chemicals Inc.) | 0.7 parts by mass |
| surfactant<br>(MEGAFAC F-178K manufactured by Dainippon Ink and Chemicals Inc.) | 3.8 parts by mass |
| solvent | |
| methyl ethyl ketone | 540 parts by mass |
| toluene | 145 parts by mass |
| dimethylformamide | 23 parts by mass |

| (Composition of Image Receiving Layer Coating Solution) | |
|---|---|
| binder<br>(S-REC BX-10 manufactured by Sekisui Chemical Co., Ltd.) | 44 parts by mass |
| binder<br>(TAKELAC EF-8911 manufactured by Takeda Chemical Industries, Ltd.) | 76 parts by mass |
| antistatic agent<br>(SUNSTAT 2012A manufactured by Sanyo Chemicals Industries, Ltd.) | 10 parts by mass |
| surfactant<br>(MEGAFAC F-176PF manufactured by Dainippon Ink and Chemicals Inc.) | 0.4 parts by mass |

-continued

| | |
|---|---|
| methanol | 380 parts by mass |
| n-propyl alcohol | 150 parts by mass |
| 1-methoxy-2-propanol | 170 parts by mass |

Next, a support on which the above-described layers were applied was prepared.

With regard to an image receiving support used (white PET (LUMIRROR E-68L manufactured by Toray Industries, Inc.) having a thickness of 135 μm), skin layers which contained calcium carbonate powders (average particle diameter: about μm) were superposed on both sides of a core layer which contained air bubbles.

The cushion intermediate layer coating solution was applied onto the support using a rotating applicator (wheeler) with its revolution being adjusted such that the dry thickness of the cushion intermediate layer coating solution was 16 μm. Then, the coated support wad dried for two minutes in an oven at 100° C. As a result, a cushion layer was formed.

Further, the image receiving layer coating solution was applied onto the cushion layer using a bar applicator. A bar count was selected such that the dry thickness of the image receiving layer coating solution was 2 μm. Then, the coated support was dried for two minutes in the oven at 100° C. to form the image receiving sheet.

Comparative Example 2

Composition of Image Receiving Layer Coating Solution

An image receiving sheet was prepared in the same manner as that of Comparative Example 1 except that the composition of the image receiving layer coating solution in Comparative Example 1 was changed as follows.

| (Composition of Image Receiving Layer Coating Solution) | |
|---|---|
| binder (S-REC BX-10 manufactured by Sekisui Chemical Co, Ltd.) | 66 parts by mass |
| surfactant (MEGAFAC F-176PF manufactured by Dainippon Ink and Chemicals Inc.) | 14 parts by mass |
| methanol | 380 parts by mass |
| n-propyl alcohol | 210 parts by mass |
| 1-methoxy-2-propanol | 170 parts by mass |

Example 1

An image receiving sheet was prepared in the same manner as that of Comparative Example 1 except that the composition of the image receiving layer coating solution in Comparative Example 1 was changed as follows.

| (Composition of Image Receiving Layer Coating Solution) | |
|---|---|
| binder (S-REC BX-10 manufactured by Sekisui Chemical Co., Ltd.) | 44 parts by mass |
| binder (TAKELAC EF-8911 manufactured by Takeda Chemical Industries, Ltd.) | 76 parts by mass |
| antistatic agent (SUNSTAT 2012A manufactured by Sanyo Chemicals Industries, Ltd.) | 6 parts by mass |

-continued

| (Composition of Image Receiving Layer Coating Solution) | |
|---|---|
| surfactant (MEGAFAC F-176PF manufactured by Dainippon Ink and Chemicals Inc.) | 0.4 parts by mass |
| methanol | 380 parts by mass |
| n-propyl alcohol | 150 parts by mass |
| 1-methoxy-2-propanol | 170 parts by mass |

Example 2

An image receiving sheet was prepared in the same manner as in Comparative Example 1 except that the composition of the image receiving layer coating solution in Comparative Example 1 was changed as follows.

| (Composition of Image Receiving Layer Coating Solution) | |
|---|---|
| binder (S-REC BX-10 manufactured by Sekisui Chemical Co., Ltd.) | 66 parts by mass |
| antistatic agent (SUNSTAT 2012A manufactured by Sanyo Chemicals Industries, Ltd.) | 6 parts by mass |
| methanol | 380 parts by mass |
| n-propyl alcohol | 210 parts by mass |
| 1-methoxy-2-propanol | 170 parts by mass |

Example 3

An image receiving sheet was formed in the same manner as in Comparative Example 1 except that the composition of the image receiving layer coating solution in Comparative Example 1 was changed as follows.

| (Composition of Image Receiving Layer Coating Solution) | |
|---|---|
| binder (S-REC BX-10 manufactured by Sekisui Chemical Co., Ltd.) | 66 parts by mass |
| stabilizer (KS2000A manufactured by Kyodo Chemical Co., Ltd.) | 3 parts by mass |
| methanol | 380 parts by mass |
| n-propyl alcohol | 210 parts by mass |
| 1-methoxy-2-propanol | 170 parts by mass |

Example 4

An image receiving sheet was prepared in the same manner as in Comparative Example 1 except that the composition of the image receiving layer coating solution in Comparative Example 1 was changed as follows.

| (Composition of Image Receiving Layer Coating Solution) | |
|---|---|
| binder (S-REC BX-10 manufactured by Sekisui Chemical Co., Ltd.) | 66 parts by mass |
| surfactant (MEGAFAC F-178K manufactured by Dainippon Ink and Chemicals Inc.) | 3.8 parts by mass |

-continued

| (Composition of Image Receiving Layer Coating Solution) | |
|---|---|
| methanol | 380 parts by mass |
| n-propyl alcohol | 210 parts by mass |
| 1-methoxy-2-propanol | 170 parts by mass |

Example 5

An image receiving sheet was prepared in the same manner as in Comparative Example 1 except that the composition of the image receiving layer coating solution in Comparative Example 1 was changed as follows.

| (Composition of Image Receiving Layer Coating Solution) | |
|---|---|
| binder (S-REC BX-10 manufactured by Sekisui Chemical Co., Ltd.) | 66 parts by mass |
| surfactant (MEGAFAC F-176PF manufactured by Dainippon Ink and Chemicals Inc.) | 1.0 part by weight |
| methanol | 380 parts by mass |
| n-propyl alcohol | 210 parts by mass |
| 1-methoxy-2-propanol | 170 parts by mass |

Surface energies of image receiving layers of resultant image receiving sheets thus obtained in Comparative Examples and Examples were measured by the above-described manner. Results of measurement are shown in Table 1.

Forming of Transfer Sheet

1) Preparation of Light-to-Heat Conversion Layer Coating Solution

The following components were mixed together while being stirred to prepare a light-to-heat conversion layer coating solution.

| (Composition of Coating Solution) | |
|---|---|
| infrared ray absorbing dye (NK-2014 manufactured by Nihon Kanko-Shikiso Co, Ltd.) | 10 parts by mass |
| binder (RICACOAT SN-20 manufactured by New Japan Chemical Co., Ltd.) | 200 parts by mass |
| N-methyl-2-pyrrolidone | 2000 parts by mass |
| surfactant (MEGAFAC F-177 manufactured by Dainippon Ink and Chemicals Inc.) | 1 part by weight |

2) Forming of Light-to-Heat Conversion Layer on Support Surface

The resultant light-to-heat conversion layer coating solution was applied on one surface of a polyethylene terephthalate film having a thickness of 100 μm (center line average roughness Ra=0.08 μm) using a rotating applicator (wheeler). Then, the coated film was dried for two minutes in an oven at 100° C. As a result, the light-to-heat conversion layer was formed on the support. The resultant light-to-heat conversion layer had a maximum absorption at about 830 nm in a wavelength range of 700 to 1000 nm. The absorbance (optical density; OD) of the resultant light-to-heat conversion layer was OD=1.0. A thickness of the light-to-heat conversion layer was measured by observing a cross-section thereof using a scanning electron microscope, and the thickness was 0.3 μm on average.

3) Preparation of Cyan Image Forming Coating Solution

Predetermined amounts of polymer binder, pigment and dispersing aid were placed in a mill of a kneader. Then the mixture was subjected to shear force while a little amount of solvent was added thereto. In this way, a diffusion pretreatment was carried out. The solvent was further added to the resultant dispersion, and the dispersion was adjusted so as to finally have the composition shown below. Next, glass beads were added to the dispersion and the resultant dispersion was dispersed by a sand mill for two hours. Thereafter, the glass beads were removed. As a result, a cyan pigment dispersed mother liquor was prepared.

| (Composition of Pigment Dispersed Mother Liquor) | |
|---|---|
| polyvinyl butyral (DENKA BUTYRAL #2000-L having a Vicat softening point of 57° C. manufactured by Denki Kagaku Kogyo Kabushiki Kaisha) | 12 parts by mass |
| coloring material (cyan pigment C.I. PB15:3) | 12 parts by mass |
| dispersing aid (SOLSPERSE S-20000 manufactured by ICI Japan Ltd.) | 0.8 parts by mass |
| n-propyl alcohol | 110 parts by mass |

Respective components shown below were mixed together while being stirred to prepared a cyan image forming layer coating solution.

| (Composition of Coating Solution) | |
|---|---|
| above-mentioned pigment dispersed mother liquor | 20 parts by mass |
| n-propyl alcohol | 60 parts by mass |
| N-hydroxyethyl-12-hydroxystearic acid amide | 0.24 parts by mass |
| surfactant (MEGAFAC F-176PF manufactured by Dainippon Ink and Chemicals Inc.) | 0.01 parts by mass |

4) Forming of Cyan Image Forming Layer on Surface of Light-to-Heat Conversion Layer The cyan image forming layer coating solution was applied on the surface of the light-to-heat conversion layer using a wheeler for one minute. The coated support was dried for two minutes in an oven at 100° C. As a result, a cyan image forming layer was formed on the light-to-heat conversion layer. The absorbance (optical density; OD) of the resultant cyan image forming layer measured using a Macbeth densitometer TD-504 (B) was OD=0.66. The thickness of the cyan image forming layer was measured by observing a cross-section thereof using a scanning electron microscope, and the thickness thereof was 0.4 μm on average.

A heat transfer sheet in which a light-to-heat conversion layer and a cyan image forming layer were sequentially formed on a support was formed by the above-described steps.

Laser recording was carried out as follows. The image receiving sheet was superposed on the transfer sheet, and the superposed sheets were retained on a cylindrical drum by vacuum-suctioning. Then the superposed sheets were exposed with a semiconductor laser from a back surface side of the transfer sheet. The exposure was carried out in such a manner that the laser was turned on and off every two pixels in a rotating direction of the drum (in the main scanning direction) while the superposed sheets were moved in a direction perpendicular to the rotating direction (in the subscanning direction). A beam diameter of the laser was about 10 μm, a distance between pixels was about 10 μm, and an exposure energy on an exposed surface was about 190 mj/cm$^2$. After the exposure, the transfer sheet was peeled from the image receiving sheet and an image was obtained on the image receiving sheet. The printed image receiving sheet was superposed on an art paper and the superposed sheets were passed through a heat roller of 4.5 kgf/cm at about 130° C. such that the image receiving layer on which the image had been formed was set in heat-contact with the art paper. Then, the image receiving sheet was peeled at an interface between the image receiving layer and the cushion layer. As a result, a final image formed by an ink layer and the image receiving layer was formed on the art paper. The reflection density of the final image was measured by a commercially available densitometer (Xrite 938 manufactured by X-Rite, Incorporated.). The higher the sensitivity became, the larger the size of one pixel became, resulting in high reflection density. Results of measurement are shown in Table 2. FIG. 1 shows a relationship between the surface energy of the image receiving layer and the reflection density of the final image at that time.

TABLE 2

| No. | Surface Energy of Image Receiving Sheet (mj/m$^2$) | Reflection Density of Final Image |
|---|---|---|
| Comparative Example 1 | 38.0 | 0.182 |
| Comparative Example 2 | 40.9 | 0.147 |
| Example 1 | 26.7 | 0.288 |
| Example 2 | 29.5 | 0.273 |
| Example 3 | 24.5 | 0.373 |
| Example 4 | 23.0 | 0.354 |
| Example 5 | 34.2 | 0.195 |

From the results of Table 2 and FIG. 1, it is found that the reflection densities of the final images obtained in the heat transfer recording method using the image receiving sheets of Examples are higher than those of the final images obtained in the heat transfer recording method using the image receiving sheets of Comparative Examples. Further, the smaller the surface energy of the image receiving layer becomes, the higher the reflection density of the recorded image becomes, resulting in high sensitivity.

As described above, in accordance with the present invention, an image receiving sheet with high sensitivity can be obtained by suppressing the surface energy of an image receiving layer. Thus, recording speed can be increased to improve the productivity in the heat transfer sheet recording method.

What is claimed is:

1. An image receiving sheet comprising a support and an image receiving layer disposed on the support, wherein said image receiving layer includes surface energy of 23 to 35 mj/m$^2$.

2. The image receiving sheet according to claim 1, further comprising a cushion layer provided between said support and said image receiving layer.

3. The image receiving sheet according to claim 2, wherein said image receiving layer includes surface energy of 23 to 30 mj/m$^2$.

4. The image receiving sheet according to claim 2, wherein said image receiving layer comprises a thickness from 0.1 to 10 μm.

5. The image receiving sheet according to claim 4, wherein said image receiving comprises a thickness from 0.5 to 5 μm.

6. The image receiving sheet according to claim 1, wherein said image receiving layer includes surface energy of 23 to 30 mj/m$^2$.

7. The image receiving sheet according to claim 1, wherein said image receiving layer comprises a thickness from 0.2 to 80 μm.

8. The image receiving sheet according to claim 7, wherein said image receiving layer comprises a thickness from 0.5 to 50 μm.

9. An image receiving sheet comprising:

(a) a support;

(b) cushion layer including a high polymer disposed on the support; and (c) an image receiving layer including a high polymer disposed on the cushion layer, and including an exterior surface comprising a surface energy of 23 to 35 mj/m$^2$.

10. The image receiving sheet according to claim 9, wherein the cushion layer comprises a thickness from 5 to 50 μm.

11. The image receiving sheet according to claim 10, wherein the cushion layer comprises an elastic modulus no greater than $49\times10^4$ kPa for providing cushioning.

12. The image receiving sheet according to claim 11, wherein at least one of the cushion layer and the image receiving layers comprises a plasticizer.

13. A method of forming an ink image, the method comprising the steps of:

(a) placing an image receiving sheet comprising a support and an image receiving layer disposed on the support, with the image receiving layer including a surface energy of 23 to 35 mj/m$^2$, in close contact with a heat transfer sheet;

(b) forming an image on the image receiving sheet by heat transfer; and (c) transferring the ink image to a permanent support.

14. The method according to claim 13, wherein said image receiving sheet includes a cushion layer between said support and said image receiving layer.

15. The method according to claim 14, wherein said image receiving layer includes surface energy of 23 to 30 mj/m$^2$.

16. The method according to claim 14, wherein said image receiving comprises a thickness from 0.1 to 10 μm.

17. The method according to claim 16, wherein said image receiving layer comprises a thickness from 0.5 to 5 μm.

18. The method according to claim 13, wherein said image receiving layer includes surface energy of 23 to 30 mj/m$^2$.

19. The method according to claim 13, wherein said image receiving layer comprises a thickness from 0.2 to 80 μm.

20. The method according to claim 19, wherein said image receiving layer comprises a thickness from 0.5 to 50 μm.

* * * * *

UNITED STATES PATENT AND TRADEMARK OFFICE

CERTIFICATE OF CORRECTION

PATENT NO. : 6,689,717 B2
DATED : February 10, 2004
INVENTOR(S) : Junichi Fujimori It is certified that error appears in the above-identified patent and that said Letters Patent is hereby corrected as shown below:

Column 20,
Lines 1-3, claim 5, should read as follows:

5. The image receiving sheet according to Claim 4, wherein said image receiving layer comprises a thickness from 0.5 to 5 μm.
Lines 47-48, claim 16, should read as follows:

16. The method according to Claim 14, wherein said image receiving layer comprises a thickness from 0.1 to 10 μm.

Signed and Sealed this

Twenty-second Day of June, 2004

JON W. DUDAS
*Acting Director of the United States Patent and Trademark Office*